US006394592B1

(12) United States Patent
Michele et al.

(10) Patent No.: US 6,394,592 B1
(45) Date of Patent: May 28, 2002

(54) INK RESERVOIR

(75) Inventors: Helmut Michele, Castrop-Rauxel; Dirk Klein, Hagen; Peter Busch, Bochum, all of (DE)

(73) Assignee: ARTECH GmbH design + production in plastic (DE)

( * ) Notice: Subject to any disclaimer, the term of this patent is extended or adjusted under 35 U.S.C. 154(b) by 0 days.

(21) Appl. No.: 09/653,766

(22) Filed: Sep. 1, 2000

(51) Int. Cl.[7] ..... B41J 2/175
(52) U.S. Cl. ..... 347/86
(58) Field of Search ..... 347/85, 86, 87; 101/125

(56) References Cited

U.S. PATENT DOCUMENTS

| | | | | |
|---|---|---|---|---|
| 3,799,053 A | * | 3/1974 | Rabelow | 101/125 |
| 5,103,243 A | | 4/1992 | Cowger | 346/1.1 |
| 5,900,895 A | | 5/1999 | Merrill | 347/86 |
| 5,971,530 A | | 10/1999 | Hashimoto | 347/86 |

FOREIGN PATENT DOCUMENTS

| | | | |
|---|---|---|---|
| DE | 9017966.8 | 9/1993 | |
| DE | 195 34 577 | 3/1996 | B41J/2/175 |
| EP | 0 603 516 | 6/1994 | B41J/2/175 |

* cited by examiner

*Primary Examiner*—Ahn T. N. Vo
(74) *Attorney, Agent, or Firm*—Hoffman Wasson & Gitler PC

(57) ABSTRACT

The present invention pertains to an ink reservoir for an inkjet printer, having a chamber that can be filled with ink, in the underside of which is an ink outlet with an ink discharge opening. In order to make the delivery of the ink uniform and independent of fluid movements of the ink contained therein, the invention suggests that the ink outlet be configured in a siphon-like fashion, having a segment that extends from the ink discharge opening into the interior of the chamber and that makes a transition via a deflection bend w into an intake opening that is directed towards the chamber bottom from inside.

7 Claims, 1 Drawing Sheet

INK RESERVOIR

FIELD OF THE INVENTION

The present invention pertains to an ink reservoir for an inkjet printer, having a chamber that can be filled with ink, in the underside of which is an ink outlet with an ink discharge opening.

PRIOR ART

Such ink reservoirs are known in the widest possible variety of designs, and are used for supplying inkjet print heads in inkjet printers or plotters. Depending on the design, the inkjet reservoir has a housing that is combined with the actual inkjet print head into an integral structural unit, or it forms a pure supply tank that can be connected by its ink discharge opening with the supply line of a print head via suitable connecting means. In conjunction with this, the external shape of the housing is individually adapted to a special printer type on an individual basis. However, it is common to a large number of these designs that the housing is essentially cubical, in which the ink outlet with the actual ink discharge opening is located on the underside, i.e., at the bottom.

As a rule, the print head connecting means, which are usually configured as a connecting arbor or hollow needle, require a corresponding connecting sleeve or something similar, which guides and seals the hollow needle, and which therefore must have a corresponding mounting depth. In practice, this leads to designs such as those known from German Patent No. DE 195 34 577 A1 or EP 0 603 516 A2, for example. In the designs that derive from these, the housing has relatively flat walls on the outside, in which the ink outlet with the previously mentioned seat for the hollow connecting needle includes a connecting sleeve in the shape of a dome formed into the underside of the chamber. This structural shape makes possible a compact external design, and for that reason it is often used, and even when the chamber is filled with a sponge-like ink storage medium or, as in EP 0 603 516 A2, can flow freely within the chamber. Also known are designs such as described in DE 195 34 577 A1, which differ only in that no foam or sponge is present.

Particular in the case of the last-mentioned ink chambers with free-flowing ink, the problem arises that the ink supply cannot be completely used up when the level of the fluid falls below the level of the connecting sleeve formed into the bottom. In addition, the inertial forces during the traveling back and forth of the ink reservoir during printing sometimes lead to an uncontrolled buildup of oscillations of the fluid, so that the ink discharge opening is not wetted with ink even with volumes that are only partly emptied and intermittent printing occurs because the print head is drawing in air.

As a result of the problems mentioned above, the task is to make available an ink reservoir for free-flowing ink with the features mentioned at the beginning, which ensures a uniform and secure withdrawal of ink, and specifically, independently of the given level and possible movement of the ink content.

To perform this task, the invention suggests that, starting with an ink reservoir of the type mentioned at the beginning, the ink outlet be configured in a siphon-like manner, with a segment that extends from the ink discharge opening into the interior of the chamber and makes a transition via a deflection bend into an intake opening that is directed towards the chamber bottom from inside.

SUMMARY OF THE PRESENT INVENTION

According to the invention, a siphon is integrated into the chamber bottom, i.e., a curved flow channel, the segment of which has both of its openings directed downward. In this regard, the one opening is identical to the ink discharge opening and, with regard to the connecting means, can be configured like the connecting sleeves that are known in the art. As an alternative, the print head can also be fastened there directly. Located at the other end of the siphon is a intake opening through which the ink is drawn from the chamber. The special arrangement according to the invention consists in the fact that the intake opening is directed perpendicularly towards the chamber bottom from above with little in between.

The special advantages of the invention result from the fact that the outward flow of ink through the siphon's intake opening is practically independent of the level in the chamber, i.e. of the actual level of the ink, just as long as the height of the level does not fall below the slight distance between the intake opening and the chamber bottom. Naturally, this advantage is especially beneficial in the case of ink reservoirs where the chamber is filled with free-flowing ink. First, thanks to the invention the outward flow of ink to the print head is independent of the height of the connecting sleeve, which is determined by the length of the hollow connecting needle or arbor. Second, a fluid surface that fluctuates in an irregular fashion will not have any effect on a uniform outward flow of ink, even when the chamber is partly empty.

The slight distance between the intake opening and the chamber bottom should be dimensioned in such a way that the product of the edge length of the intake opening and the distance approximately corresponds to the required flow cross section of the ink outlet. As a rule, this will lead to a distance of well below 1 mm. This results in the additional advantage that, because of the surface tension present on the ink, nearly complete emptying of the chamber is readily achievable, and specifically, is independent of the length of the connecting sleeve.

An especially advantageous design of the ink outlet according to the invention provides that the one segment is a tube section, which is directed perpendicularly upward and over which is mounted a deflecting cap that overlaps it at a radial and axial distance. In this way, a kind of coaxial siphon is formed. In terms of length and diameter, the central tube section is dimensioned in such a way that it is suitable for accommodating the hollow needle or arbor on the printer. At the top, the tube section is cut off evenly. The deflecting cap is set onto the tube end from above, in which the annular gap between the outer wall of the tube section and the inner wall of the deflecting cap forms the other segment of the siphon. The intake opening is thus given an annular shape as well, and is located surrounding the passage edge of the intake tube at the chamber bottom. At the top, the annular space empties between the cap and tube via the axial distance present there between the top of the covering cap and the tube end in the tube section.

A particular advantage of the design mentioned above lies in the symmetrical design. In addition, it makes for especially simple manufacture: the tube section can be formed onto the housing, i.e., the chamber, as one piece, and can have retaining ribs that protrude radially. The latter should be dimensioned in such a way that the deflecting cap can be mounted securely through friction tightness alone. The latter can also be designed as an inexpensive and efficient to manufacture injection molded plastic part.

Moreover, it is an advantage that placed parallel to each other in the chamber are dividing walls whose bottom edges end above the chamber bottom. This means that a number of separate ink chambers are formed, which, however, can communicate with each other through the gap at the bottom between the dividing walls and the chamber bottom. The special advantage of this arrangement lies in the fact that even with severe movements, e.g., during the reversal of direction of the print head during printing, the fluid itself builds up oscillations less severely than if only one large chamber were present. The flow to the intake opening of the ink outlet on the chamber bottom is always assured. In conjunction with this, it is preferable that the distance between the dividing walls and the chamber bottom, i.e., the flow gap, is dimensioned approximately the same as the distance between the intake opening of the ink outlet and the chamber bottom.

The ink discharge opening is advantageously provided with connecting means for an inkjet print head. What is meant by this are, for example, seals and similar components that make possible the tight seating of a hollow connecting needle and are located in the outer segment of the siphon.

As an alternative, the ink reservoir can be nondetachably joined to an inkjet print head, which is then joined with the ink reservoir as an integral unit instead of via the previously mentioned connecting means.

BRIEF DESCRIPTION OF THE DRAWINGS

In the following, advantageous embodiments of the invention are explained in more detail with the aid of the drawings. Specifically, the following are shown.

DETAILED DESCRIPTION OF A PREFERRED EMBODIMENT

Figure 1:
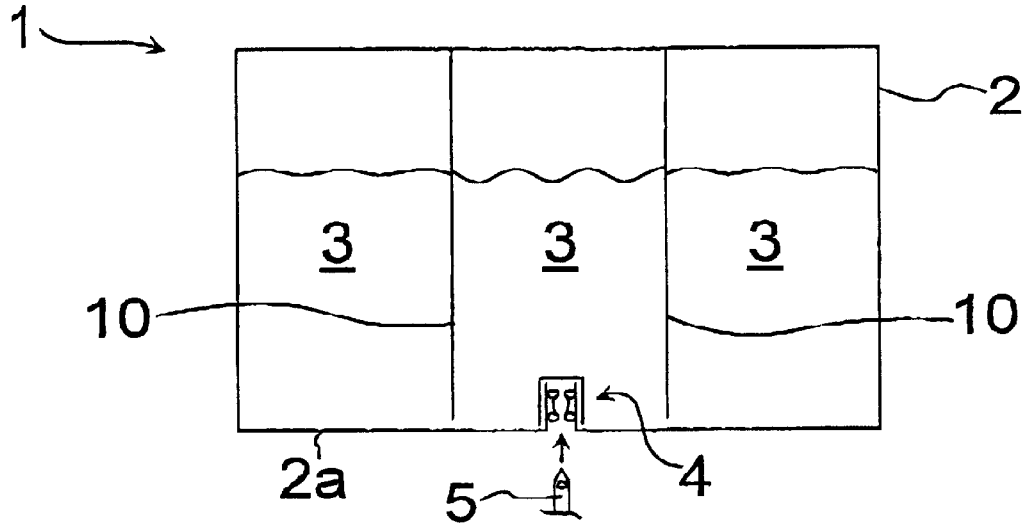
FIG. 1 A schematic sectional representation through an ink reservoir according to the invention.

Shown schematically in section form in FIG. 1, and provided therein in its entirety with reference number 1, is an ink reservoir. It consists of an essentially cubical plastic housing 2, which is filled with free-flowing ink 3.

At the bottom of the housing 2 is an ink outlet according to the invention, which is provided in its entirety with reference number 4 and which has a downward-directed ink discharge opening into which a hollow connecting needle 5 of an inkjet printer or plotter (not shown) can be inserted as indicated by the arrow.

Figure 2:
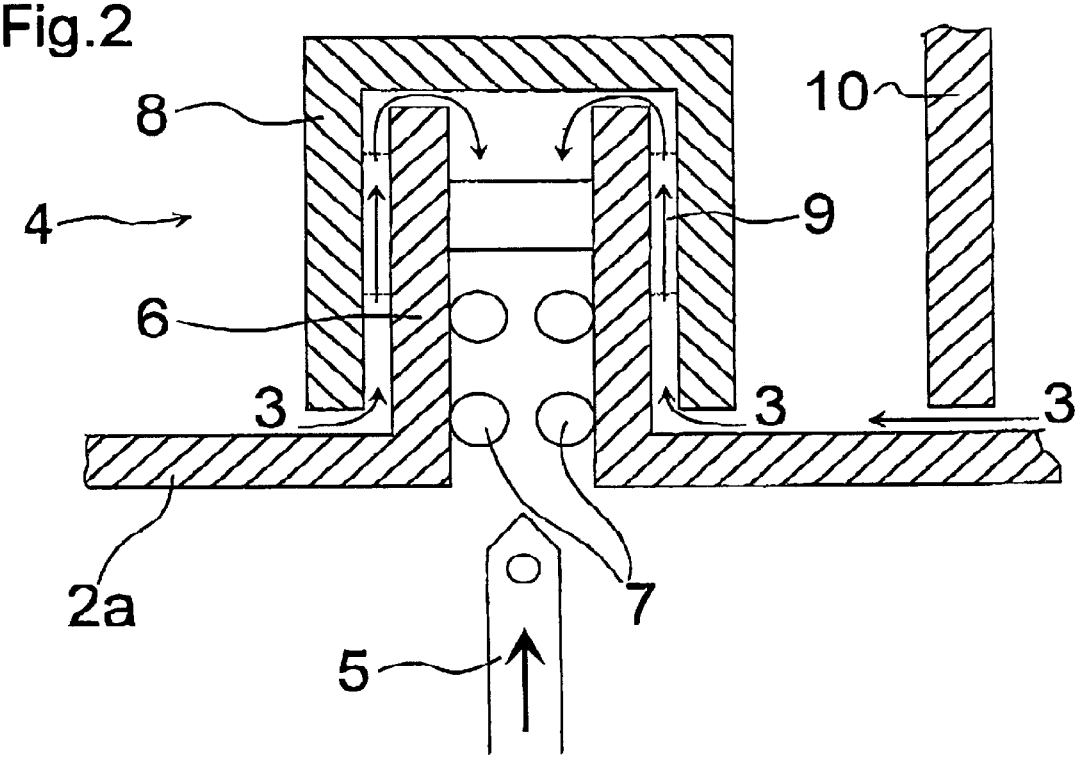
FIG. 2 An enlarged detail view from FIG. 1.

Shown in FIG. 2 enlarged and in all of its details is the ink outlet 4 according to FIG. 1, in which the same reference numbers are used. It can be seen that formed onto the housing bottom 2*a* is a segment 6, which extends into the interior of the housing 2, i.e., into the ink chamber, is in essence designed as a tube section, has at its lower end the ink discharge opening for accommodating the hollow connecting needle 5, and is cut off evenly at its upper end.

Placed in the passage opening of the segment 6 are sealing and connecting means 7, which can, for example, contain O-rings, a penetrable septum, or something similar.

Placed on the segment 6 from above is a deflecting cap 8, which is at an axial distance from the upper end and surrounds it at a radial distance, in which said cap is firmly fixed in place via friction tightness by the retaining ribs 9 that are molded onto the outside of the tube section 6 and that are shown as dashed lines. The lower edge of the deflecting cap 8 is at a slight distance from the inside of the housing bottom 2*a,* as a result of which a narrow, peripheral annular gap is formed, into which the ink 3—as indicated by the bent arrows—can flow. In addition, it flows through the annular gap between the outside of the tube sleeve 6 and the inside wall of the deflecting cap 8, in which it is deflected at the cover of the cap 8 in a siphon-like manner in the direction of the reverse, U-shaped arrows and into the cross section of the tube sleeve 6, and thus makes its way to the ink discharge opening of the hollow connecting needle 5.

The special advantage of the invention lies in the fact that, thanks to the siphon-like course of the flow, the ink 3 can be removed, i.e., drawn out, via the hollow connecting needle 5 until the ink level falls below the width of the gap between the lower edge of the deflection cap 8 and the housing bottom 2. In practice, this distance can be dimensioned so narrowly that, due to the surface tension, the ink 3 can be removed with almost nothing left behind. These advantageous effects are independent of how long the hollow connecting needle 5 is and, correspondingly, how far the tube section 6 extends into the ink chamber, i.e., into the housing 2.

According to an advantageous further development of the invention, it is possible to add to the housing 2 dividing walls 10 that extend across the housing cross section, but leave a small passage gap free between their underside and the housing 2, i.e., the housing bottom 2*a.* As a result, the interior of the housing is divided into narrow compartments in which the ink 3 held within them is less inclined to build up oscillations, even during rapid movements of the ink reservoir 1, than if the housing 2 were not divided. This has the advantage that even with severe movements, e.g., during the reversal of direction during printing, the instantaneous ink level at the ink outlet 4 will not drop to the extent that air is drawn in through the hollow connecting needle 5.

What is claimed is:

1. An ink reservoir for an inkjet printer comprising:

a chamber that can be filled with ink, the chamber having a chamber bottom, an ink outlet in said chamber bottom, said ink outlet having a discharge opening, a segment extending from said discharge opening into the interior of said chamber wherein said segment is a tube section directed upwardly, and a deflecting cap overlapping said tube section at a radial and axial distance.

2. The ink reservoir according to claim 1, wherein said deflection cap is placed on at least one retaining rib that protrude radially from said tube section.

3. An ink reservoir for an inkjet printer comprising:

a chamber that can be filled with ink, the chamber having a chamber bottom, an ink outlet in said chamber bottom, said ink outlet having a discharge opening and an intake opening extending from said chamber bottom and having a height, a segment extending from said discharge opening into the interior of said chamber, at least one dividing wall formed in said chamber, said at least one dividing wall having a bottom edge spaced from said chamber bottom, wherein a distance between said at least one dividing wall and said chamber bottom is approximately the same size as the height of said intake opening.

4. The ink reservoir of claim 3, wherein said at least one dividing wall is two dividing walls.

5. The ink reservoir of claim 3, wherein said ink outlet has a tube section extending upwardly from said chamber bottom, a deflection cap overlapping said tube section at a radial and axial distance, said deflection cap having a bottom edge, said intake opening formed between the bottom edge of the deflection cap and the chamber bottom.

6. A printing apparatus, comprising an inkjet printer, an ink reservoir, said ink reservoir having a chamber with a chamber bottom, an ink outlet in said chamber bottom, said ink outlet having a discharge opening, a siphon over said discharge opening, said siphon having a first leg extending upwardly from said discharge opening and having a top end, and a second leg extending from said first leg top end and extending toward said chamber bottom.

7. The printing apparatus of claim 6, wherein said second leg surrounds said first leg.

* * * * *